United States Patent [19]

Giuffredi

[11] 4,062,478

[45] Dec. 13, 1977

[54] VALVES FOR AEROSOL CONTAINERS

[76] Inventor: Giancarlo Giuffredi, Piazza Firenze 6, Milan, Italy

[21] Appl. No.: 751,949

[22] Filed: Dec. 17, 1976

Related U.S. Application Data

[63] Continuation-in-part of Ser. No. 577,871, May 15, 1975.

[30] Foreign Application Priority Data

May 21, 1974 Italy ..... 23016/74

[51] Int. Cl.[2] ..... B65D 83/14

[52] U.S. Cl. ..... 222/402.16; 222/402.24

[58] Field of Search ..... 222/402.16, 402.21, 222/402.24, 402.17, 402.18, 402.19, 402.2, 402.22, 402.23, 402.25; 141/20

[56] References Cited

U.S. PATENT DOCUMENTS

| | | | |
|---|---|---|---|
| 3,158,297 | 11/1964 | Ferry, Jr. et al. | 222/402.16 |
| 3,219,069 | 11/1965 | Kuffer | 222/402.16 X |
| 4,015,752 | 4/1977 | Meuresch | 222/402.16 |

*Primary Examiner*—Allen N. Knowles
*Assistant Examiner*—Norman L. Stack, Jr.
*Attorney, Agent, or Firm*—Steinberg & Blake

[57] ABSTRACT

A filling valve for an aerosol container or the like has an endless channel surrounding a predetermined axis and having a transverse wall, an inner rim projecting from an inner region of this transverse wall and an outer rim projecting from an outer region of the transverse wall to an extent greater than the inner rim, this transverse wall being formed with at least one opening passing therethrough. A mounting cup has a central wall portion extending transversely with respect to the above axis and engaging the outer rim at an edge thereof distant from the transverse wall of the channel and extending inwardly from the outer rim toward the above axis. This central wall portion of the mounting cup is formed with a central opening through which the above axis extends, and the central wall portion of the mounting cup has an inner peripheral edge defining the central opening and situated closer to the above axis than the inner rim. In a gap which is defined between the inner rim and the central wall there is a resilient deformable, compressible seal member compressed between the inner rim and the central wall portion of the mounting cup, the arrangement being such that when the fluid under pressure is directed through the central opening of the transverse wall portion of the mounting cup the seal member will deflect at its outer periphery into the above channel so that the fluid under pressure will flow through the opening of the transverse wall thereof into a container.

8 Claims, 4 Drawing Figures

VALVES FOR AEROSOL CONTAINERS

CROSS-REFERENCE TO RELATED APPLICATION

This application is a continuation-in-part of copending application Ser. No. 577,871, filed May 15, 1975.

BACKGROUND OF THE INVENTION

The invention relates to a filling valve for aerosol containers, and more particularly to a valve wherein a high pressure fluid can pass through channels therein, these channels not being used during dispensing of the contents from the interior of the container.

Valves are already known for aerosol containers or for liquified gases, wherein outward sealing is assured by way of a resilient gasket which becomes deformed by the fluid introduced into the container during filling thereof with high pressure fluid with a valve applied thereto. Certain types of these valves have the disadvantage of being readily tampered with from the exterior of the container so that it is possible to permit fraudulent dispensing of the contents of such containers.

Other types of valves, intended for sequentially dispensing very small amounts of aerosol, have the disadvantage of requiring an unduly extended period of time for filling up the container.

SUMMARY OF THE INVENTION

It is a primary object of the present invention to provide a valve of a simple structure and low cost, with this valve being capable of permitting high pressure fluid to be introduced at high speed into a container to which the valve is applied.

Another object of the invention is to provide a valve of this type which cannot be tampered with from the outside of the container.

These and other objects are brought about by way of a valve which has a hollow body which at one end thereof is joined with a mounting cup of an aerosol container. At the latter end of the hollow body and externally thereof, provision is made for an annular channel or groove defined by a transverse wall projecting from the hollow body, an outer annular rim projecting from the periphery of this transverse wall and engaging the mounting cup, and an inner annular rim which is concentric with the outer rim but is of a lesser height than the latter. This transverse wall of the channel is formed with at least one opening passing therethrough. Between the hollow body and the mounting cup there is positioned a resilient seal which is retained in pressed condition at the cup only by way of the inner rim of the channel.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
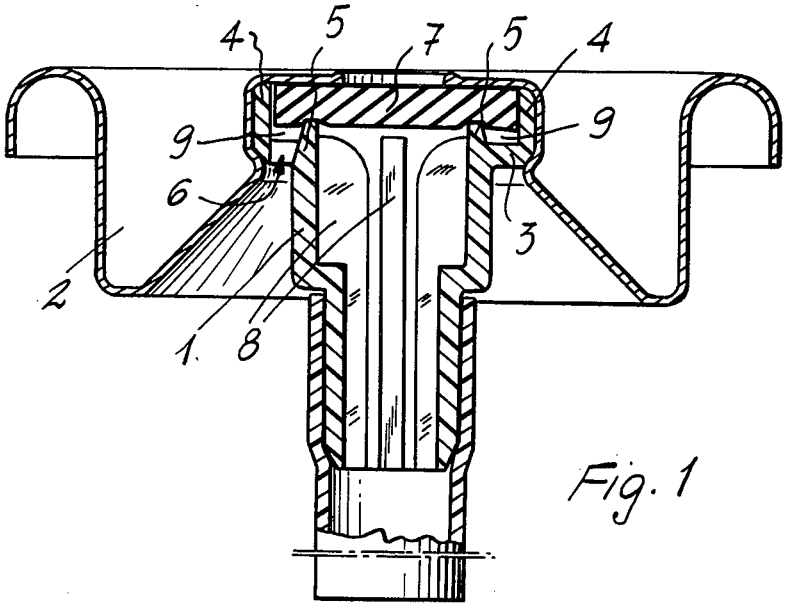
FIG. 1 is an axial sectional elevation of one embodiment of the invention showing a valve of the invention in its rest condition.
Figure 2:
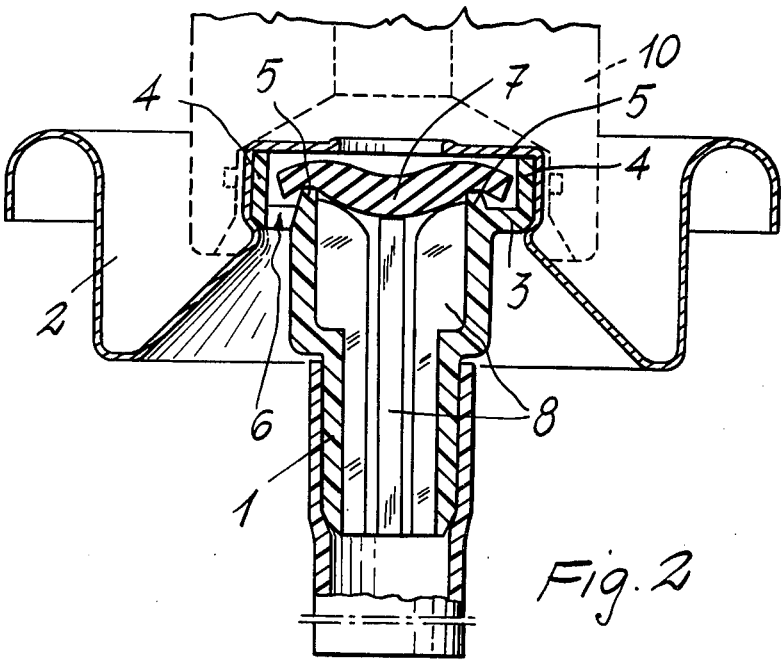
FIG. 2 illustrates the valve of FIG. 1 during filling of a container.

Referring now to FIGS. 1 and 2, there is shown therein, in axial section, a valve of the invention intended to be applied to a non-rechargeable type of cylinder, bottle, or the like, which is to say containers which, when used, are completely emptied and cannot be reused, such as cylinders or bottles for fire extinguishers, refillers for camping gas (generally butane gas) hot plates, and the like. Such a valve comprises a hollow body 1 clawed to a mounting cup 2 which, in a known way, can in turn be applied to an aerosol container or bottle. Adjacent the upper end of hollow body 1, there is an annular channel or groove, defined by a bottom transverse wall 3 projecting from the body 1, an outer annular edge or rim 4 directly engaging the mounting cup 2 and projecting from the outer peripheral edge of the bottom or transverse wall 3, and an inner edge or rim 5 which is substantially concentric with the outer rim 4 but which projects upwardly from the transverse wall 3 to a lesser extent than the outer rim 4, as illustrated.

Thus, the transverse wall 3 together with the inner rim 5 and outer rim 4 define an endless channel means 9 surrounding a predetermined central axis which forms the common axis of the rims 4 and 5. The transverse wall 3 of the channel means 9 is formed with one or more openings 6 passing therethrough. The mounting cup 2 has an upper central wall portion extending transversely with respect to the above axis and engaging the outer rim 4 at an edge thereof which is distant from the transverse wall of the channel means 3. This central wall portion of the mounting cup extends inwardly from the outer rim 4 toward the above axis and is formed with a central opening through which the above axis extends. It will be noted from FIGS. 1 and 2 that this central opening of the mounting cup is defined by an inner peripheral edge thereof situated closer to the above axis than the inner rim 5 of the channel means 9. Thus, the inner rim 5 and the central wall portion of the mounting cup 2 define between themselves a predetermined gap, and a resilient, deformable, compressible seal means 7 is compressed between the inner rim 5 and the central wall portion of the mounting cup 2. It will be noted that at the outer rim 4 the mounting cup has an outer peripheral portion extending along the outer surface of the outer rim 4 and rigidly fixed therewith in the manner apparent from FIGS. 1 and 2. Thus it will be seen that the seal means 7 is pressed only between the inner rim 5 and the central wall portion of the mounting cup. Moreover, in the rest position of the parts shown in FIG. 1, the seal means 7 has its outer peripheral edge extending along and situated directly next to the inner surface of the outer rim.

As is shown in FIGS. 1 and 2, the tubular body 1 has integrally formed therewith internal longitudinally extending ribs 8 which project radially from the inner surface of the tubular body 1, and these ribs extend up to the region of the seal means 7.

Of course, the mounting cup 2 is joined to a container for a fluid under pressure. Inasmuch as the outer rim 4 of the channel means 9 has a fixed position with respect to the mounting cup 2, the space between the inner rim 5 and the mounting cup is precisely determined so that in this way the extent to which the seal means 7 is compressed by the upper edge of the inner rim 5 is also precisely determined. In any event, between the seal means 7, the inner and outer rims 5 and 4, respectively, and the transverse wall 3 is defined the empty annular channel means 9 which communicates with the interior of the container through the opening or openings 6.

In the rest condition shown in FIG. 1, seal means 7 assures a perfect sealing of the container by being compressed between the inner rim 5 and the central wall portion of the mounting cup 2. The pressure of the fluid in the interior of the container acts through the opening or openings 6 against the peripheral portion of the seal means 7 to press the outer peripheral portion thereof which extends outwardly beyond the inner rim 5 against the central wall portion of the mounting cup 2, so as to contribute in this way also to the sealing of the container. In other words, the fluid under pressure in the container is situated in the channel 9 to press the outer peripheral portion of the seal 7 against the central wall portion of the cup 2 so as to contribute to the sealing of the container.

In order to dispense the container contents, the seal 7 must be pierced, so that the container will be completely emptied. Even if a pressure should be exerted from the exterior on the seal 7, such as by an elongated thin member, the seal 7 would become deformed but still would be firmly clamped between the rim 5 and the mounting cup, and in any event the product in the container would be prevented from escaping, so that in this way there is an assurance that the contents of the container will remain therein.

Once the above-described valve has been clawed onto a container, and it is desired to introduce a high pressure fluid at high speed into the container, it is sufficient to lower onto the central portion of the cup 2 a head 10 (FIG. 2) of a conventional pressure filling machine, and the fluid under pressure can then be supplied. The head 10 is illustrated in phantom lines in FIG. 2.

As is shown in FIG. 2, the fluid under pressure causes the sealing means 7 to be compressed against the rim 5 and away from the apertured central wall portion of the mounting cup 2. It will be noted that the seal means 7 does not penetrate into the interior of the hollow body 1 because of the fact that the inward deflection of the seal means 7 by the fluid under pressure is limited by the top ends of the ribs 8. Thus, the seal means 7 responds to the high pressure fluid which is to be filled into the container to be compressed thereby toward the inner rim 5, and it will be seen from a comparison of FIGS. 1 and 2 that the position of the rim 5 remains unchanged during filling of the container. The seal means 7 thus becomes spaced from the central wall portion of the mounting cup to define with the latter a space through which the high pressure fluid can enter from the central opening of the transverse wall portion of the mounting cup through this latter space and past the peripheral edge of the seal means 7 and then through the opening or openings 6 in the transverse wall 3 of the channel means 9 into the interior of the container on which the mounting cup is mounted. At this time, as shown in FIG. 2, the seal means 7 deflects at its outer peripheral edge in response to the high pressure fluid toward the transverse wall 3 of the channel means 9 so as to become situated at least in part in the channel means between the inner and outer rims thereof during filling of the container with the high pressure fluid. Thus the transverse wall 3 of the channel means 9 also has a position which remains substantially unchanged with respect to the mounting cup during filling of the container with the high pressure fluid. Thus it is apparent from FIGS. 1 and 2 that the bottom wall 3 of the endless channel means 9 is of sufficient rigidity to prevent displacement of the inner rim 5 with respect to the outer rim 4 along the axis surrounded by the endless channel means 9 when the high pressure fluid enters at high speed in the manner shown in FIG. 2.

Thus, the above-described valve is of a simple construction while at the same time protecting unauthorized access to the interior of the container and allowing filling up of the container following application of the valve to the container, in contrast with previously known valves where filling is carried out either through an additional auxiliary valve or by introducing fluid in a highly cooled and liquified form.

Figure 3:
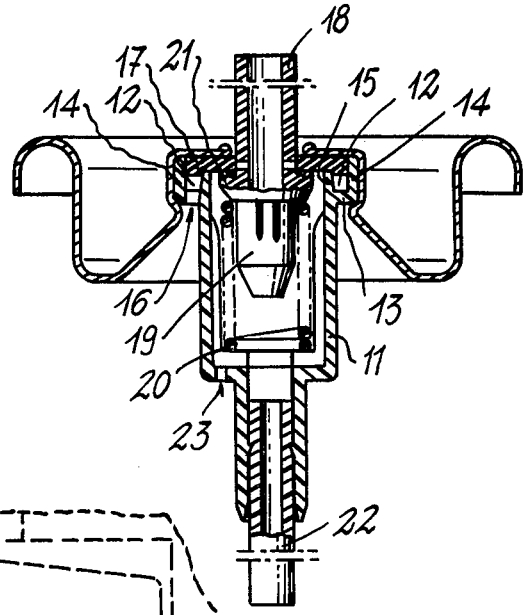
FIG. 3 is a sectional elevation of another embodiment of a valve of the invention joined with an aerosol container of which only the mounting cup is illustrated.
Figure 4:
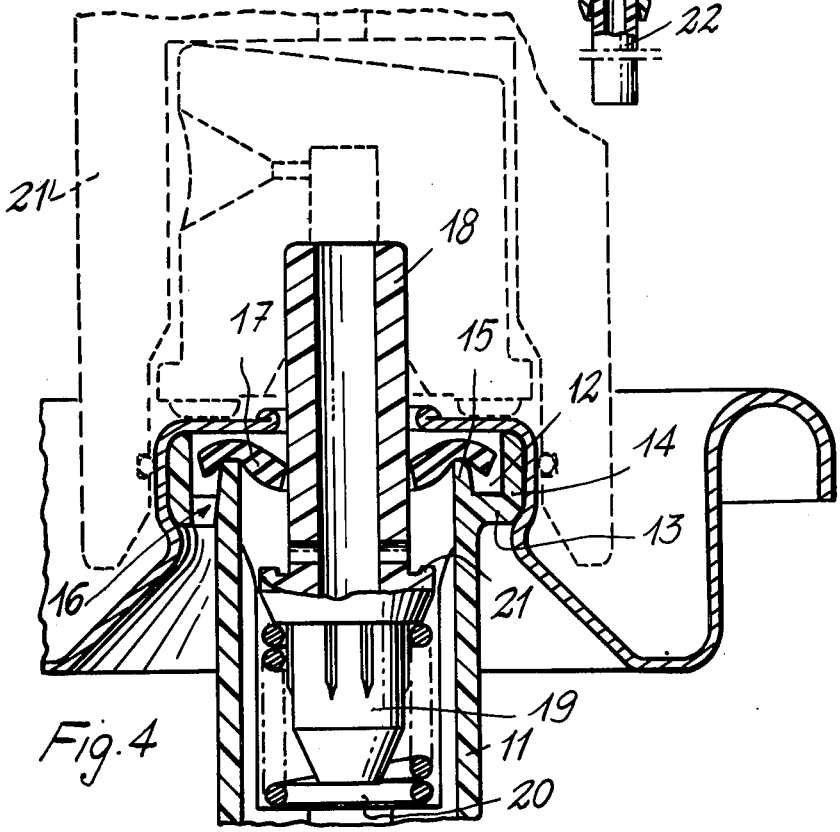
FIG. 4 shows at a scale larger than FIG. 3 how the structure of FIG. 3 operates during filling with FIG. 4 also showing in phantom lines an element mounted on top of a dispensing stem for dispensing the contents from the container.

Referring now to FIGS. 3 and 4, a valve similar to that of FIGS. 1 and 2 is shown except that the valve of FIGS. 3 and 4 can sequentially dispense limited amounts of aerosol material.

The valve of FIGS. 3 and 4 includes a hollow tubular body 11 which has an upper end region forming the inner rim 15 of the endless channel means 12 which is also defined by the transverse wall 13 and the outer rim 14 which extends from the transverse wall 13 to an extent greater than the inner rim 15. One or more openings 16 are formed in the transverse channel wall 13. In this embodiment the mounting cup is substantially identical with that of FIGS. 1 and 2 and is joined in the same way to the body 1 at the outer rim 14 of the channel means 12. In the gap between the edge of the rim 5 and the central wall portion of the mounting cup there is the resilient seal means 17 which is clamped under a controlled pressure between the rim 15 and the mounting cup. However in this embodiment the seal means 17 has a central opening through which the hollow stem of a movable element extends. This stem 18 has a portion 19 accommodated in the cavity of the body 11 and urged upwardly by a spring 20. The spring 20 engages a flange 21 integral with the stem 18 and projecting outwardly therefrom, this flange 21 having an upwardly directed lip which is thus pressed against the lower surface of the seal means 17 in the manner apparent from FIG. 3.

Thus, in the rest position of the parts shown in FIG. 3, assuming that the mounting cup is clawed onto a container, sealing by way of the valve is assured inasmuch as the lip of the flange 21 is urged against the seal means 17, while the seal means 17 itself is clamped between the inner rim 15 of the channel means 12 and the central wall portion of the mounting cup. At the same time the inner edge defining the central opening of the seal means 17 presses against the exterior surface of the stem 18 to provide a further sealing action at this location.

It will be seen that in this case also, the fluid under pressure situated in the channel 12 presses against the outer peripheral portion of the seal 17, situated outwardly beyond the inner rim 15 of the channel means 12. Thus this outer peripheral portion of the seal means 17 is pressed axially against the central wall portion of the mounting cup so as to contribute in this way to the sealing of the container. Furthermore, it will be seen that in both embodiments of the invention the outer peripheral edge of the seal means 7 or 17 extends along the inner surface of the outer rim 4 or 14, respectively. Thus, there is no tendency, as a result of this latter feature, for the fluid under pressure in the channel means to compress the outer peripheral edge of the seal means radially inwardly toward the central axis which is surrounded by the channel means.

After the mounting cup with the valve have been clawed onto the container, when it is desired to introduce a high pressure fluid at high speed into the container, it is sufficient to lower onto the structure shown in FIG. 3 a head 21' (FIG. 4) of a conventional filling machine, and thus allow for passage of pressure fluid. It is to be noted that at this time the stem 18 will initially be in the position shown in FIG. 3. For the sake of convenience the stem 18 is shown in FIG. 4 with an actuating button thereon shown in phantom lines, this actuating button being conventional and capable of being depressed in opposition to the spring 20 so as to enable the stem to be lowered to the position shown in FIG. 4 for dispensing the contents of the container out through the stem 18 and through the passage in the actuating button which is shown in phantom lines in FIG. 4. When the contents of the container are to be dispensed sequentially in small amounts by depression of the actuating button, the seal means 17 remains in the position shown in FIG. 3 while the stem 18 is lowered in opposition to the spring 20 to the position shown in FIG. 4, and thus in this way the contents of the container can discharge outwardly through the tube 22 shown at the lower part of FIG. 3 as well through an opening 23 formed in an annular portion of the body 11, into the interior of the body 11 around the stem 18 to flow through radial openings thereof situated just above the lip of the flange 21 so that the contents of the container will flow under pressure into the stem 18 and out through the passage of the actuating button.

However, during filling of the container the stem 18 is in the position of FIG. 3, and the head 21' is lowered so that the fluid under pressure will now travel through the central opening of the mounting cup in the space of this central opening which surrounds the stem 18, and now this fluid under pressure will compress the seal means 17 so that it will assume the condition shown in FIG. 4 enabling the fluid under pressure to flow in the space between the compressed seal means 17 and the upper central wall portion of the mounting cup to reach the channel 12 and flow through the opening or openings 16 thereof into the container to fill the latter.

It will be noted that also in the case of FIGS. 3 and 4 the transverse wall 13 and the inner rim 15 of the endless channel means 12 have a position which remains substantially unchanged with respect to the mounting cup when the high pressure fluid enters the container. Thus in this case also the transverse wall 13 of the endless channel means 12 is of sufficient rigidity to prevent axial displacement of the inner rim 15 with respect to the outer rim 14 when the high pressure fluid enters the container.

Thus, the valve construction of FIGS. 3 and 4 is particularly suitable for sequentially dispensing small amounts of aerosol material which flows into the interior of the hollow body 11 through the tube 22 shown in FIG. 3 and through one or more small holes 23 formed in the body 11.

Thus, during filling of the container with the construction of FIGS. 3 and 4, the spring 20 maintains the lip or flange 21 against the lower surface of the seal 17 so that all of the fluid enters into the container to fill the same only by flowing past the outer peripheral edge of the deformed seal means 17 and through the channel 12 and openings 16 into the interior of the container. Thus, with both embodiments the filling of the container takes place by flow of the fluid through the central opening of the central wall portion of the mounting cup and then radially through the space between this wall portion of the mounting cup and the compressed sealing member, past the outer peripheral edge of the latter and through the channel and the opening or openings in the bottom wall thereof into the interior of the container.

It is thus apparent that with both embodiments of the invention the introduction of the pressure fluid at high speed into the container is carried out by way of passages which are not utilized when dispensing the fluid. As a result, the openings or passages utilized for introducing the pressure fluid into the container may have a comparatively large area while providing for dispensing the contents of the container valves with the same characteristics or features as known valves.

Moreover, it will be noted that with both embodiments of the invention the seal means 7 or 17 extends freely outwardly beyond the inner rim 5 or 15 into engagement with the inner surface of the outer rim 4 or 14, so that the seal means 17 is not supported at its lower outer surface region which extends radially beyond the inner rim. In this way the pressure fluid which is supplied to the interior of the container can readily deflect the outer periphery of the seal means 7 or 17 downwardly into the channel so as to provide an effective flow path of large area for the fluid into the container through the opening or openings formed in the lower transverse wall 3 or 13 of the channel means. As a result of this feature it is possible for all of the fluid supplied to the interior of the container to flow through the central opening of the central transverse wall portion of the mounting cup. Additional openings for this purpose are not required in the mounting cup, and it is not required to take up any space in the interior of the channel means with components which support the sealing means at its lower surface where the lower surface of the seal means extends across the interior of the channel means 9 or 12.

What is claimed is:

1. A filling valve for an aerosol container or the like, comprising endless channel means surrounding a predetermined axis and having a transverse wall, an inner rim projecting from an inner region of said transverse wall and an outer rim projecting from an outer region of said transverse wall to an extent greater than said inner rim, said transverse wall being formed with at least one opening passing therethrough, a mounting cup having a central wall portion extending transversely with respect to said axis and engaging said outer rim at an edge thereof distant from said transverse wall of said channel means and extending inwardly from said outer rim toward said axis, said central wall portion of said mounting cup being formed with a central opening through which said axis extends and said central wall portion of said mounting cup having an inner peripheral edge defining said central opening and situated closer to said axis than said inner rim, said central wall portion of said mounting cup being spaced from said inner rim to define a gap therewith and said mounting cup having at the outer periphery of said central wall portion an axially extending wall portion extending along an outer surface of said outer rim and rigidly fixed therewith, and resilient, deformable, compressible seal means compressed between said inner rim and said central wall portion of said mounting cup and having in a rest position an outer peripheral edge extending along and situated directly next to an inner surface of said outer rim, said seal means responding to high pressure fluid which is to be filled into a container to be compressed thereby toward said inner rim, while the position of the latter with respect to said mounting cup remains substantially unchanged, away from said central wall portion of said mounting cup to define with the latter a space through which the high pressure fluid can enter from said central opening of said transverse wall portion of said mounting cup through said space and past the peripheral edge of said seal means and through said opening in said transverse wall of said channel means into the interior of a container on which said mounting cup is mounted, said seal means deflecting at its outer peripheral edge in response to the high pressure fluid toward said transverse wall of said channel means to become situated at least in part in said channel means between said inner and outer rims thereof during filling of the container with the high pressure fluid, whereby said transverse wall of said channel means also has a position which remains substantially unchanged with respect to said mounting cup during filling of the container with high pressure fluid.

2. The combination of claim 1 and wherein said seal means extends across said central opening of said transverse wall portion of said mounting cup for preventing escape of fluid out of a container until the seal means is pierced.

3. The combination of claim 2 and wherein a plurality of ribs are fixed to said channel means inwardly of said inner rim thereof at the side of said seal means opposite from said central wall portion of said mounting cup for limiting the displacement of said seal means into the space surrounded by said inner rim during filling of a container.

4. The combination of claim 1 and wherein said seal means is formed with a central opening smaller than and aligned with said central opening of said central wall portion of said mounting cup, and dispensing valve means extending through said central opening of said seal means as well as through said central opening of said central wall portion of said mounting cup for dispensing contents from the interior of the container through said dispensing valve means.

5. The combination of claim 4 and wherein said seal means has at said central opening thereof an edge which engages said dispensing valve means to provide a seal with said dispensing valve means.

6. The combination of claim 5 and wherein said dispensing valve means has at the side of said seal means opposite from said central wall portion of said mounting cup an endless lip directed toward said seal means, and said dispensing valve means including a spring urging said lip into engagement with said seal means.

7. The combination of claim 4 and wherein a tubular body forms an extension of said inner rim and extends therefrom away from said seal means, a drawing tube of small diameter being connected with said tubular body and extending therefrom.

8. The combination of claim 7 and wherein said tubular body is also formed with a small hole.

* * * * *